US005989418A

United States Patent [19]

Shin

[11] Patent Number: 5,989,418

[45] **Date of Patent: *Nov. 23, 1999**

[54] FILTER FOR A WASHING MACHINE

[75] Inventor: Jung-soo Shin, Suwon, Rep. of Korea

[73] Assignee: Samsung Electronics Co., Ltd., Suwon, Rep. of Korea

[ * ] Notice: This patent is subject to a terminal disclaimer.

[21] Appl. No.: 09/028,668

[22] Filed: Feb. 24, 1998

[30] Foreign Application Priority Data

Aug. 16, 1997 [KR] Rep. of Korea ..... 97-39037
Aug. 16, 1997 [KR] Rep. of Korea ..... 97-39041

[51] Int. Cl.[6] ..... B01D 35/143; B01D 35/153; B01D 35/30; D06F 39/10

[52] U.S. Cl. ..... 210/167; 210/196; 210/238; 210/346; 210/136; 68/18 F

[58] Field of Search ..... 210/167, 196, 210/238, 346, 136; 68/18 F

[56] References Cited

U.S. PATENT DOCUMENTS 2,939,305 6/1960 Snyder .
3,626,728 12/1971 Traube .
5,509,283 4/1996 Lee .
5,661,989 9/1997 Jeon .

FOREIGN PATENT DOCUMENTS 62-14896 1/1987 Japan .
1-230394 9/1989 Japan .
3-103296 4/1991 Japan .
4-285595 10/1992 Japan .
288 469 10/1996 Taiwan .

*Primary Examiner*—Thomas M. Lithgow
*Attorney, Agent, or Firm*—Burns, Doane, Swecker & Mathis, L.L.P.

[57] ABSTRACT

A filter for a washing machine is disclosed. The filter includes a filter case attached to an inner lower portion of a dehydrating tub of the washing machine for forming a predetermined space with the dehydrating tub, including an attachment portion for being attached to the dehydrating tub and a filter receiving portion formed with an opening portion, and a pocket type filter including a front panel attached with a mesh net to one side thereof for filtering fluff intermingled in the washing water, a rear panel for forming a predetermined space with the front panel by being coupled to the front panel by means of a hinge shaft to be opened/closed while being attached with a mesh net for filtering the fluff intermingled in the washing water to one side thereof, and a check valve fixed to the lower side of the rear panel for confining the flow of the washing water introduced into the space between the front panel and the rear panel, the pocket type filter being inserted into the filter receiving portion and being made of a transparent material. Since the front panel of the pocket type filter is made of a transparent material and the pocket type filter is revealed without screening by the filter case, it is possible to measure the amount of the fluff accumulated within the pocket type filter without separating the pocket type filter from the filter case.

4 Claims, 8 Drawing Sheets

FILTER FOR A WASHING MACHINE

BACKGROUND OF THE INVENTION

1. Field of the Invention

The present invention relates to a washing machine, and more particularly to a filter for a washing machine for filtering foreign matters such as fluff from washing water.

2. Description of the Prior Art

FIG. 1 illustrates a conventional washing machine. Referring to FIG. 1, in the conventional washing machine, a washing tub 120 is suspended by a suspension 130 into inside of a case 110.

A dehydrating tub 170 and a pulsator (or an agitator; hereinafter refer to "a pulsator") 180 selectively driven by a clutch assembly 160 which is connected to a motor 150 by means of a belt 140, are disposed in the inner side of washing tub 120.

An impeller 182 as a pump is integrally formed to the lower side of pulsator 180, and a filter 190 is provided around the upper end of dehydrating tub 170. A guide portion 172 for guiding the washing water pumped by impeller 182 toward filter 190 is formed between impeller 182 and filter 190.

In the washing machine constructed as above, once pulsator 180 is rotated by motor 150 and clutch assembly 160 during a washing or rinsing cycle, the washing water pumped by impeller 182 at the lower portion of pulsator 180 is guided to filter 190 along guide portion 172 to be dropped into the interior of dehydrating tub 170 via filter 190. During this process, foreign matters intermingled in the washing water are filtered by filter 190.

However, according to the conventional washing machine constructed as above, filter 190 is arranged around the upper end of dehydrating tub 170. For this reason, when a small amount of articles is washed in a small quantity of cleaning water, the washing water cannot reach filter 190. That is, the foreign matters intermingled in the washing water cannot be sufficiently filtered by filter 190 to lower washing efficiency.

FIGS. 2 to 4 show other example of a filter for a washing machine proposed to overcome the above described problems as a example.

As illustrated, the filter for a washing machine is attached to the inner lower portion of dehydrating tub 170, which includes a filter case 300 and a pocket type filter 200 for filtering fluff by being inserted into filter case 300.

Filter case 300 is attached to the inner lower portion of dehydrating tub 170 to form a predetermined space with dehydrating tub 170, which includes an attachment portion 310 for attaching itself onto dehydrating tub 170, a front plane portion 320 formed with a plurality of discharging holes 322 and inserting guide portions 330 formed to both rear sides of front plane portion 320 while having the upper portion opened.

Pocket type filter 200 includes a front panel 210, a rear panel 230 and a check valve 250. Front panel 210 and rear panel 230 are coupled to be opened/closed by a hinge shaft 232 formed to rear panel 230, and attached with mesh nets 220 and 240 for filtering the fluff. Check valve 250 for opening/closing the space between front panel 210 and rear panel 230, is fixed to the lower side of rear panel 230 and made of a material such as a rubber.

Pocket type filter 200 as described above is inserted into the interior of the space between filter case 300 and dehydrating tub 170 by being slidably moved along inserting guide portions 330 from the upper portion of inserting guide portions 330 of filter case 300.

According to the filter as described above, the washing water pumped by impeller 182 flows into pocket type filter 200 via the space between dehydrating tub 170 and filter case 300 during the washing or rinsing cycle. Check valve 250 is upwardly pushed away by means of the washing water thereby the washing water is introduced into the interior of pocket type filter 200.

The washing water introduced into inside of pocket type filter 200 is discharged into dehydrating tub 170 via mesh nets 220 and 240 of front panel 210 and rear panel 230. At this time, the fluff within the washing water is filtered by mesh nets 220 and 240 attached to the front panel 210 and rear panel 230. Also, the washing water exhausted out of pocket type filter 200 is discharged into the interior of dehydrating tub 170 via discharging holes 322 formed in front plane portion 320 of filter case 300.

Under the state that the rotation of a pulsator is stopped after completing the washing or rinsing cycle, check valve 250 returns to its original position by means of gravity. Consequently, the filtered fluff is accumulated into the interior of pocket type filter 200 without getting away from pocket type filter 200.

The fluff accumulated on the interior of pocket type filter 200 is closely attached toward rear panel 230 due to a centrifugal force exerting upon the fluff by dehydrating tub 170 which is rotated at high speed during a dehydrating cycle. By doing so, the washing water pumped by impeller 182 can be easily introduced into pocket type filter 200 during the initial period of the next washing or rinsing cycle.

Meanwhile, as the amount of the fluff accumulated within pocket type filter 200 is increased, user grasps the upper portion of the pocket type filter and moved pocket type filter 200 in upper direction along inserting guide 230 of the filter case so as to separating pocket type filter 200 from the space between filter case 300 and dehydrating tub 170, then opens pocket type filter 200 and removes the fluff.

However, according to the other example, since front panel 210 and rear panel 230 are coupled to each other by hinge shafts 232 formed at the upper side of rear panel 230 to be closed/opened, the lower portion of front panel 210 is often departed the lower portion of rear panel 230 regardless user's will. Therefore, the fluff in pocket type filter 200 is poured down through a space between front panel 210 and rear panel 230.

By doing so, the floor where the fluff is poured is duty. If the fluff is poured down in dehydrating tub 170, the fluff affects next washing and rinsing of the laundry to lower the washing efficiency of the washing machine.

In addition, since side walls of rear panel 230 are inserted into the inner sides of front panel 210, it is inconvenience for user to open pocket type filter 230.

SUMMARY OF THE INVENTION

Therefore, it is an object of the present invention to provide a filter for a washing machine capable of preventing a fluff accumulated within a pocket type filter from pouring down by such a way that the pocket type filter is opened regardless user's will.

It is an another object of the present invention to provide a filter for a washing machine to easily open a pocket type filter.

To achieve the object, the present invention provides a filter for a washing machine comprising a filter case attached to an inner lower portion of a dehydrating tub of the washing machine for forming a predetermined space with the dehydrating tub, including an attachment portion for being attached to the dehydrating tub and a filter receiving portion formed with an opening portion, and a pocket type filter including a front panel attached with a mesh net to one side thereof for filtering fluff intermingled in the washing water and formed with hinge holes at lower portions thereof, a rear panel provided with hinge shafts at lower portions thereof for forming a predetermined space with the front panel by being coupled to the front panel by means of the hinge shafts being inserted into the hinge holes to be opened/closed while being attached with a mesh net for filtering the fluff intermingled in the washing water to one side thereof, and a check valve fixed to the lower side of the rear panel for confining the flow of the washing water introduced into the space between the front panel and the rear panel, the pocket type filter being inserted into the filter receiving portion.

According to the present invention, the front panel includes supporting walls which are formed at an interior of side walls thereof. The inner sides of side walls of the rear panel are contacted with the supporting walls. The pocket type filter includes a supporting part having protrusions formed at upper portion of the rear panel and apertures formed at the front panel for receiving the protrusions.

To achieve the another object, the pocket type filter includes an opening part having apertures formed at upper sides of the side walls of the front panel and knobs protruded from the side walls of the rear panel to be inserted into apertures.

Since the hinge shafts and the hinge holes which are formed at the lower portions of the front panel and the rear panel respectively couple the front panel with the rear panel to be closed/opened, the upper portion of the front panel is separated from the upper portion of the rear panel when the pocket type filter is opened. Thus, it is prevented the fluff accumulated in the pocket type filter from pouring.

In addition, since the front panel and the rear panel are firmly coupled to each other by a supporting part formed at an upper portion of the pocket type filter, it is prevented the pocket type filter from opening regardless of user's will.

Moreover, it is easy to open the pocket type filter so as to remove the fluff accumulated therein.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Figure 1:
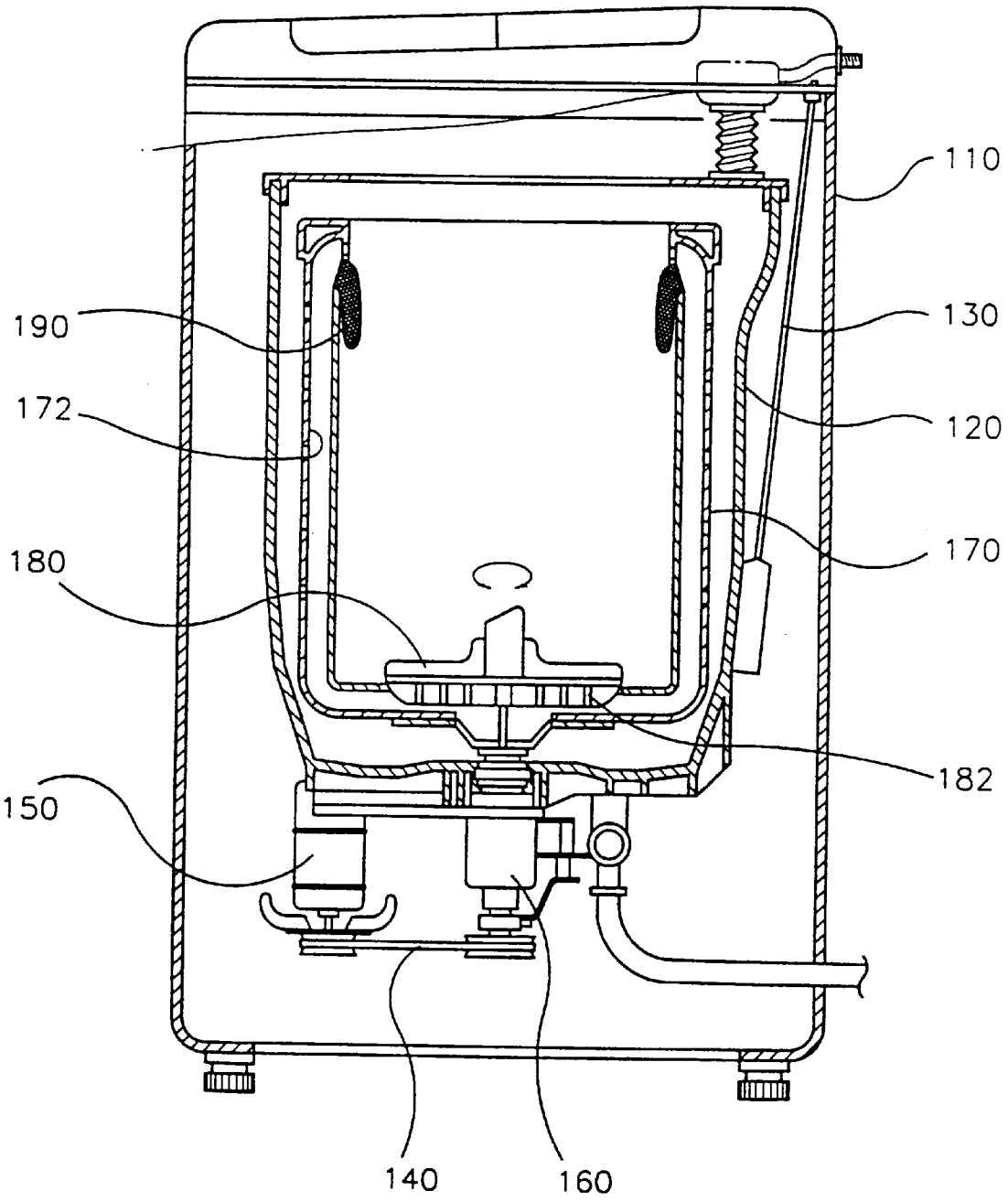
FIG. 1 (PRIOR ART)
FIG. 1 is a sectional view showing a general full automatic washing machine having a filter.
Figure 2:
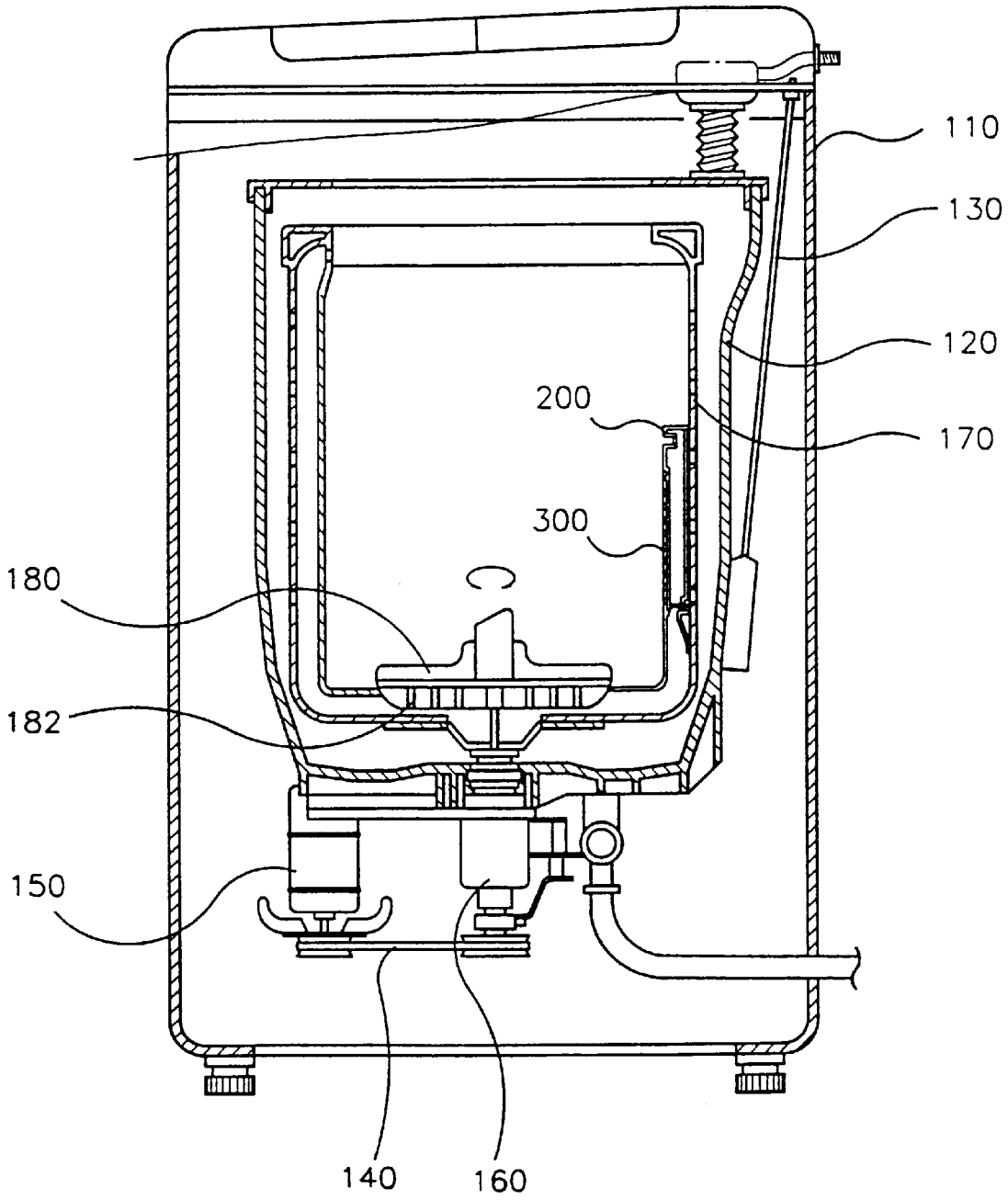
FIG. 2 (PRIOR ART)
FIG. 2 is a sectional view showing other general full automatic washing machine having a filter.
Figure 3:
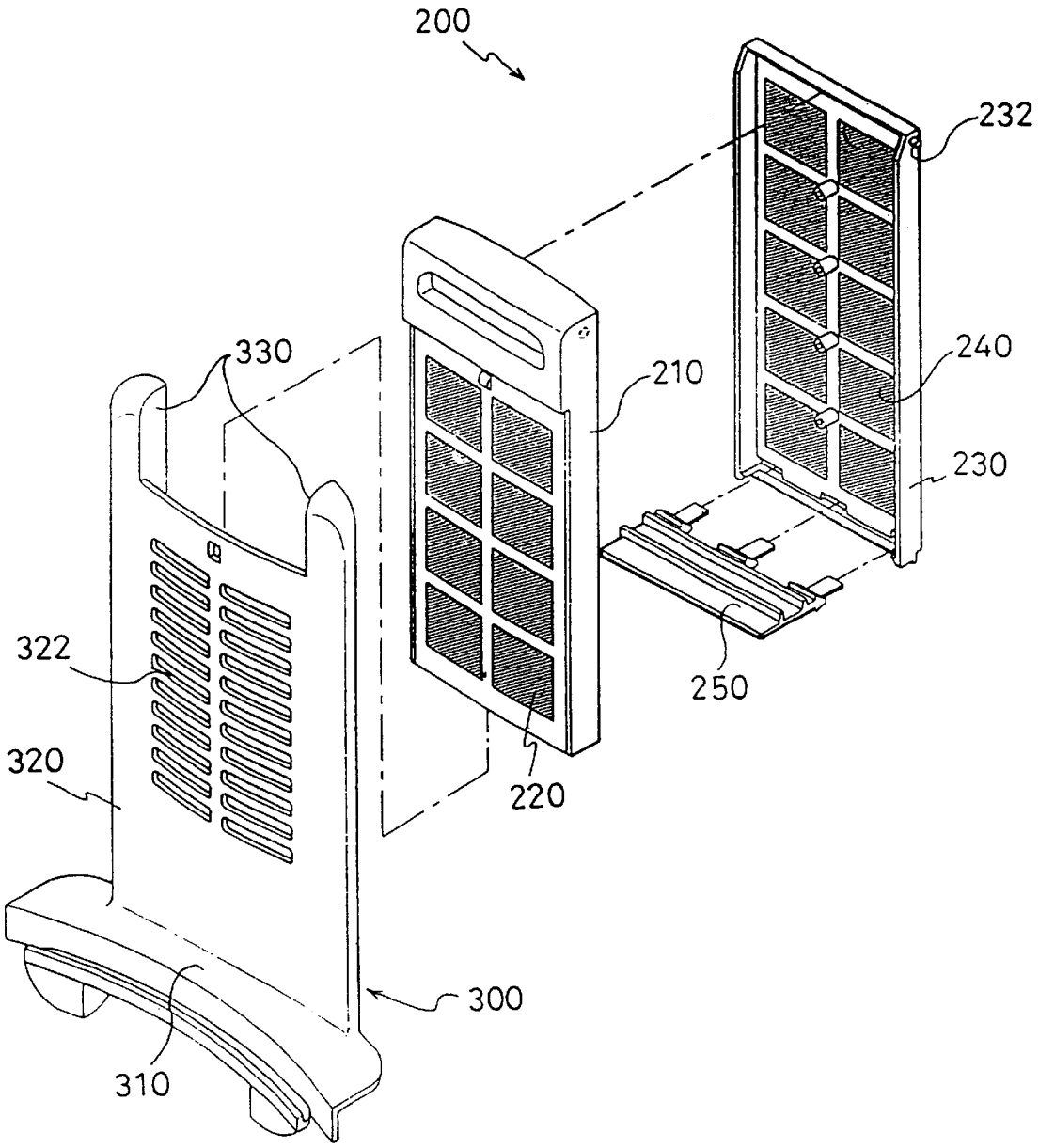
FIG. 3 (PRIOR ART)
FIG. 3 is an exploded perspective view of the filter shown in FIG. 2.
Figure 4:
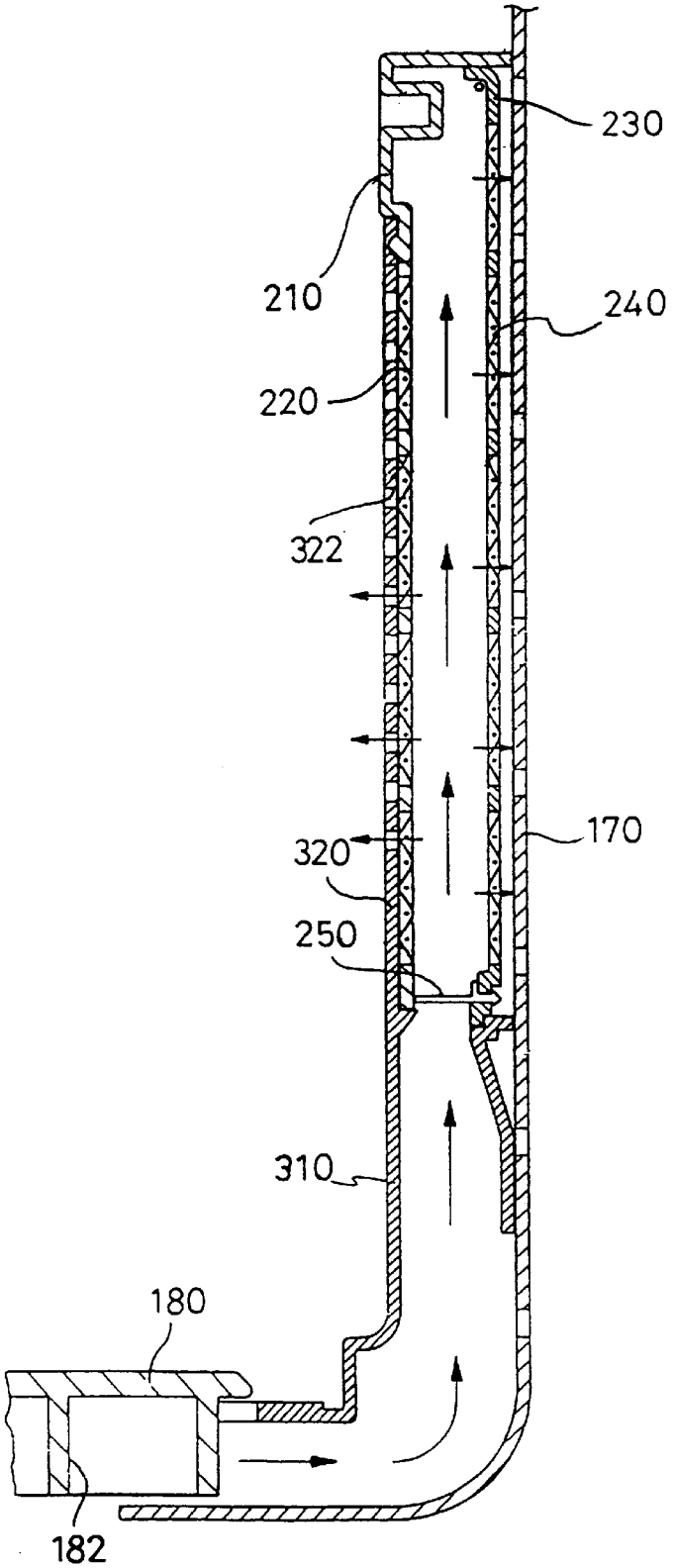
FIG. 4 (PRIOR ART)
FIG. 4 is a detailed sectional view showing the portion shown in FIG. 2 where the filter for a washing machine is mounted.
Figure 5:
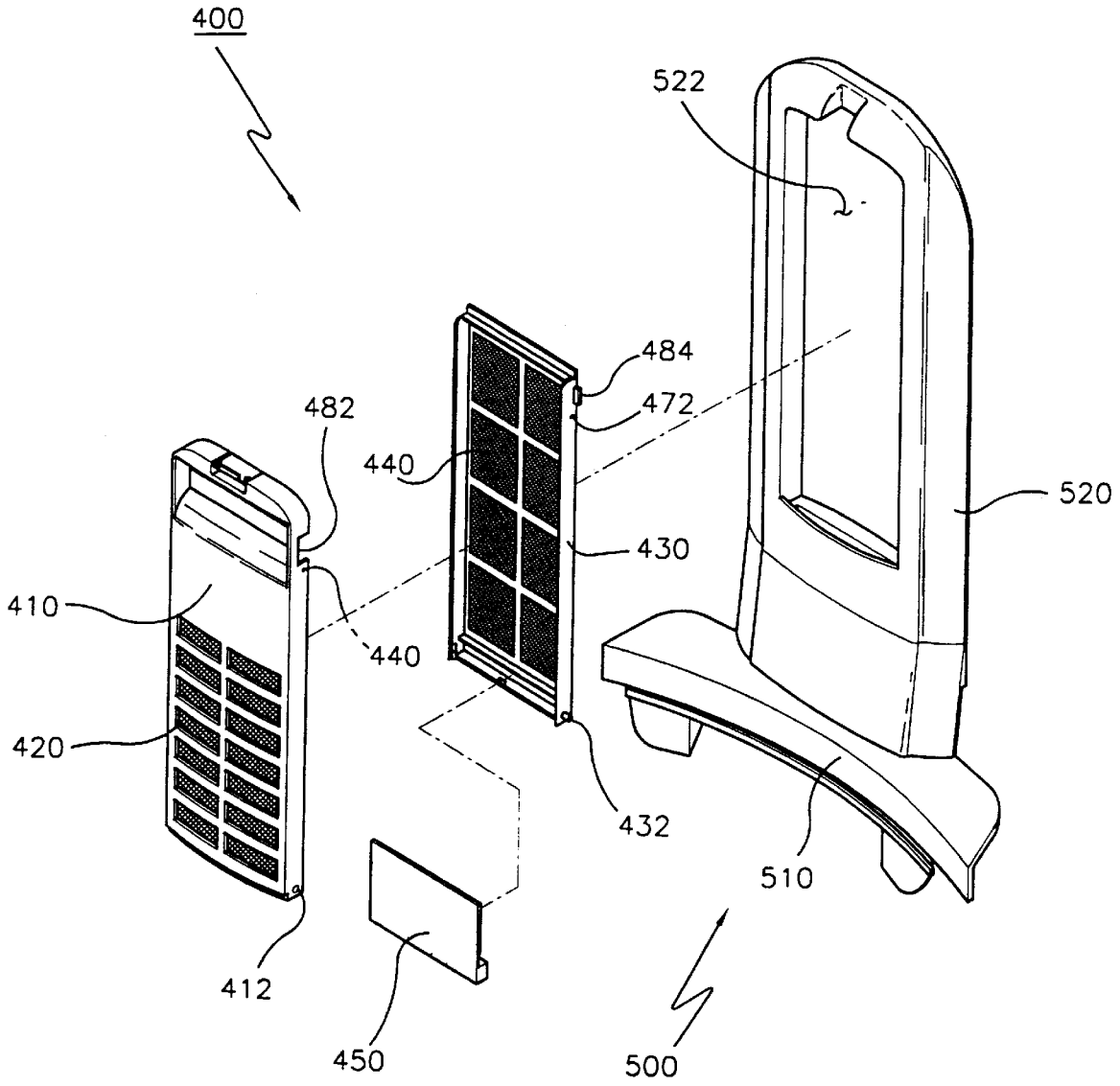
FIG. 5 is an exploded perspective view showing a filter for a washing machine according to the present invention.
Figure 6:
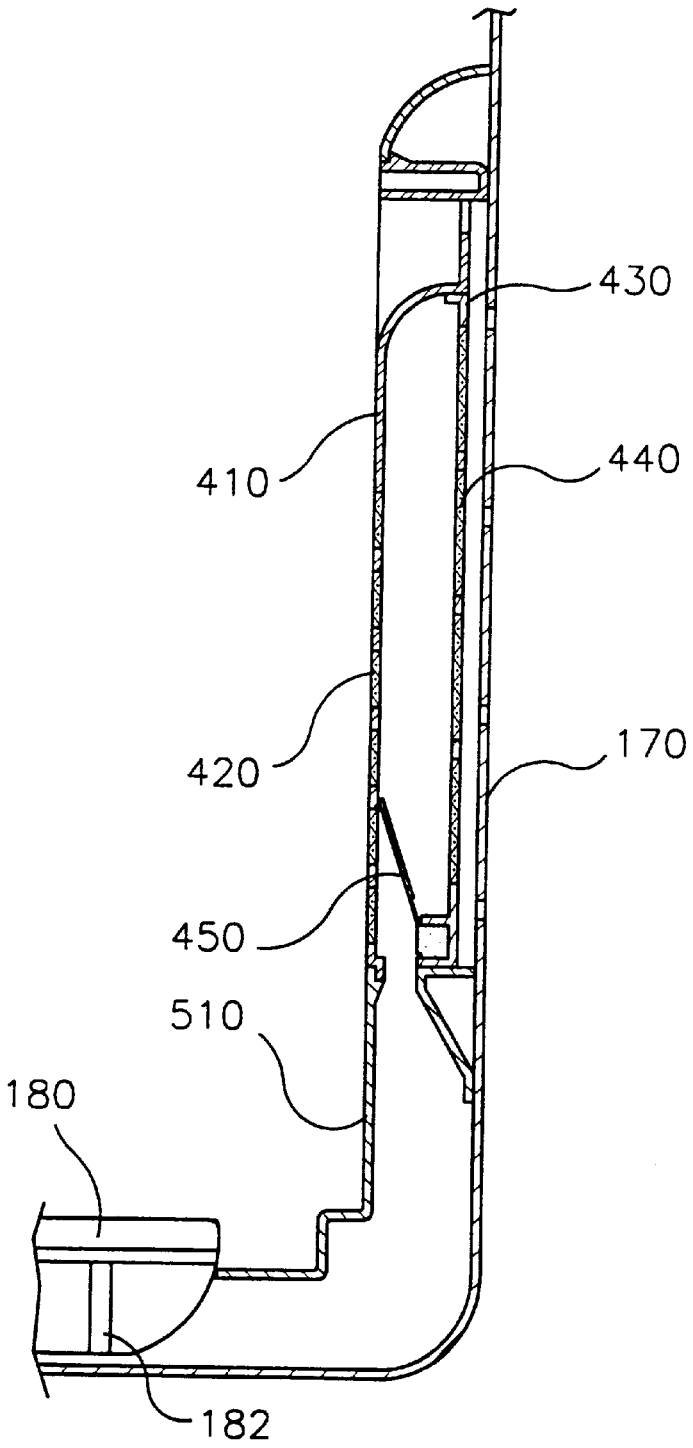
FIG. 6 is a sectional view showing a state that the filter for a washing machine according to the present invention attached to a washing machine.

A filter according to a preferred embodiment of the present invention is shown in FIGS. 5 to 8.

As illustrated in the figures, a filter for a washing machine according to the present invention is attached to the inner lower portion of a dehydrating tub 170, which includes a filter case 500 and a pocket type filter 400 for filtering fluff by being inserted into filter case 500.

Filter case 500 includes an attachment portion 510 for attaching itself onto dehydrating tub 170, and a filter receiving portion 520 formed with an opening 522 into which pocket type filter 400 is inserted.

Pocket type filter 400 includes a front panel 410, a rear panel 430, a check valve 450, supporting part 470, and a opening part 480. Front panel 410 and rear panel 430 are coupled to be opened/closed by which hinge shafts 432 formed at lower portions of rear panel 430 are inserted into hinge holes 412 formed at lower portion of front panel 410, and attached with mesh nets 420 and 440 for filtering the fluff.

Figure 7:
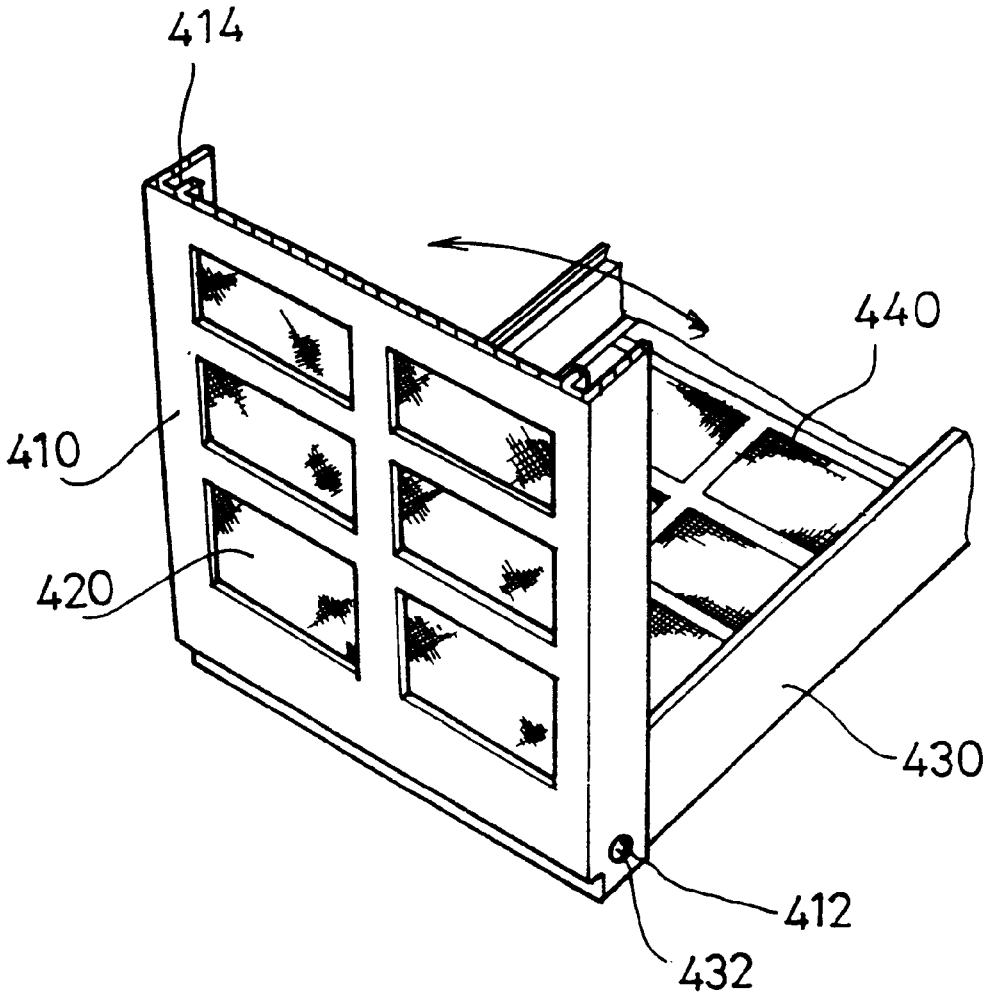
FIG. 7 is an enlarged perspective view showing a supporting wall as a main element of the filter according to the present invention.

As illustrated in FIG. 7, front panel 410 has supporting walls 414 which are formed at both side walls respectively. Supporting walls 414 are contacted with inner sides of side walls of rear panel 420 respectively when pocket type filter 400 is closed.

Figure 8:
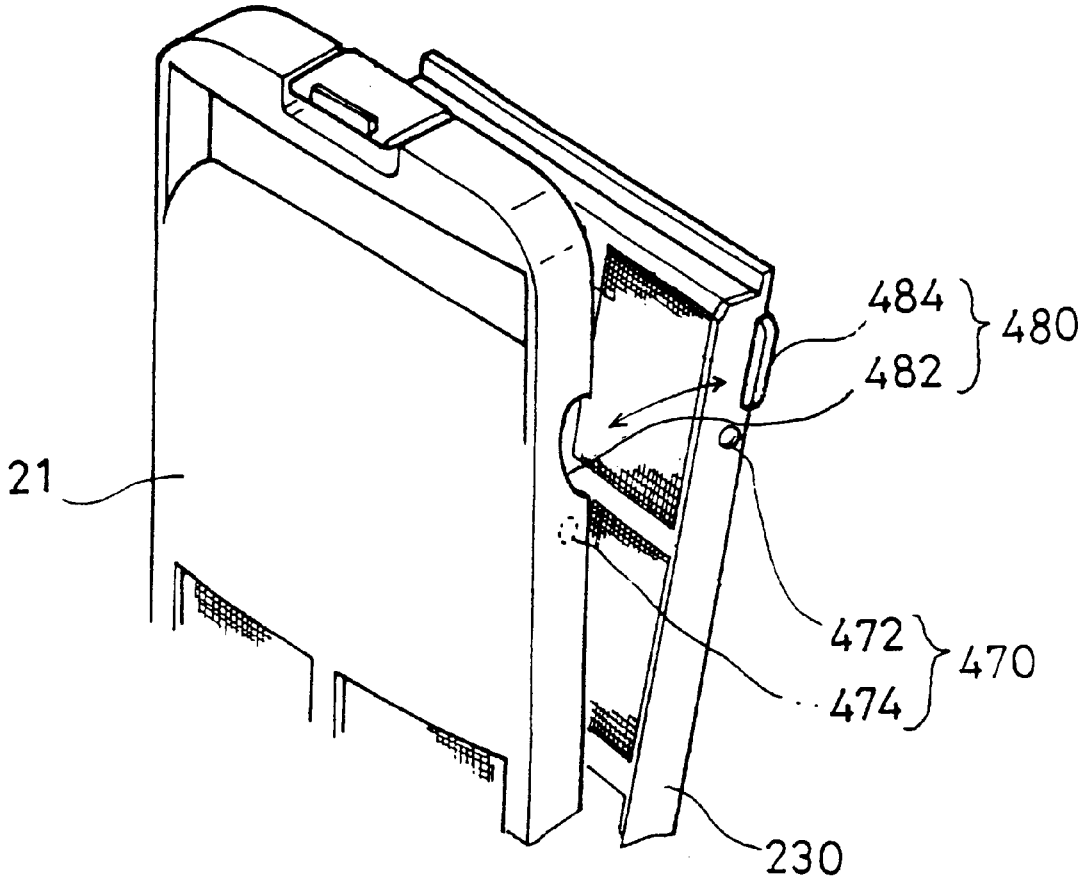
FIG. 8 is a perspective view showing a opening part and a supporting part as other main elements of the filter according to the present invention.

Supporting part 470, as shown in FIG. 8, includes a protrusion 472 and a receiving recess 474. Protrusions 472 are formed at upper ends of side walls of rear panel 420 respectively and have a semi-spherical shape. Receiving recesses 474 are formed at the side walls of front panel 410 and receive protrusions 472.

Opening part 480 is formed with apertures 482 at upper sides of the side walls of front panel 410 and knobs 484 protruded from the side walls of rear panel 430 to be inserted into apertures 482.

Check valve 450 for opening/closing the space between front panel 410 and rear panel 430, is fixed to the lower side of rear panel 430 and made of a material such as a rubber.

Since the operation of the filter for a washing machine according to the present invention is same to the operation of the other example of the prior art, the description of the operation is abbreviated.

According to the present invention as described above, since hinge shafts 432 and hinge holes 412 which couple front panel 410 and rear panel 430 to be closed/opened are formed at the lower portions of front panel 410 and rear panel 430 respectively, the lower portion of front panel 410 is not separated from the lower portion of rear panel 430 as the prior art when pocket type filter 400 is separated from filter receiving portion 520 of filter case 500 in order to remove the fluff.

In addition, since the side walls of rear panel 430 are contacted with the inner sides of the side walls and supporting walls 414 of front panel 410, supporting force due to friction is increased. Thus, between front panel 410 and rear panel 430 are firmly coupled to each other.

Moreover, front panel 410 and rear panel 430 is more firmly coupled by such a way that protrusions 472 of supporting part 470 are locked by receiving recesses 474.

Accordingly, it is prevented the fluff in the pocket type filter from pouring by opening the pocket type filter regardless of user's will when the pocket type filter is separated from the filter case in order to remove the fluff.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A filter apparatus for a washing machine comprising:

a filter case attached to an inner lower portion of a dehydrating tub of the washing machine for forming a predetermined space with the dehydrating tub, including an attachment portion for being attached to the dehydrating tub and a filter receiving portion formed with an opening portion; and a pocket filter including a front panel attached with a mesh net to one side thereof for filtering fluff intermingled in the washing water and formed with hinge holes at lower portions thereof, a rear panel provided with hinge shafts at lower portions thereof for forming a predetermined space with the front panel by being coupled to the front panel by means of the hinge shafts being inserted into the hinge holes to be opened/closed while being attached with a mesh net for filtering the fluff intermingled in the washing water to one side thereof, and a check valve fixed to the lower side of the rear panel for confining the flow of the washing water introduced into the space between the front panel and the rear panel, the pocket filter being inserted into the filter receiving portion.

2. The filter apparatus for a washing machine as claimed in claim 1, wherein the front panel further comprises side walls and supporting walls which are formed at an interior of the side walls, the rear panel including side walls having inner sides which are contacted with the supporting walls.

3. The filter apparatus for a washing machine as claimed in claim 1, wherein the pocket filter further comprises a supporting part including protrusions formed at upper portion of the rear panel and apertures formed at the front panel for receiving the protrusions.

4. The filter apparatus for a washing machine as claimed in claim 1, wherein the pocket filter further comprises an opening part including apertures formed at upper sides of the side walls of the front panel and knobs protruded from the side walls of the rear panel to be inserted into apertures.

* * * * *